US005328318A

United States Patent [19]

Fyson et al.

[11] Patent Number: 5,328,318

[45] Date of Patent: Jul. 12, 1994

[54] DISPENSING APPARATUS

[75] Inventors: John R. Fyson; Edward Charles T. S. Glover, both of London, Great Britain

[73] Assignee: Eastman Kodak Company, Rochester, N.Y.

[21] Appl. No.: 50,407

[22] PCT Filed: Sep. 15, 1992

[86] PCT No.: PCT/EP92/02113
§ 371 Date: May 10, 1993
§ 102(e) Date: May 10, 1993

[87] PCT Pub No.: U10/93/06011
PCT Pub Date: Apr. 1, 1993

[30] Foreign Application Priority Data

Sep. 24, 1991 [GB] United Kingdom ..... 9120348.9

[51] Int. Cl.[5] ..... B65B 21/02; B65B 69/00

[52] U.S. Cl. ..... 414/411; 198/705

[58] Field of Search ..... 198/703, 704, 705; 414/411, 412, 404; 222/DIG. 1

[56] References Cited

U.S. PATENT DOCUMENTS

| | | | |
|---|---|---|---|
| 1,193,826 | 8/1916 | Ruth | 198/705 |
| 1,563,237 | 11/1925 | Stallman | 198/705 |
| 2,545,377 | 3/1951 | Parisi | 198/705 |
| 2,889,958 | 6/1959 | Ekenstam et al. | 221/25 |
| 3,027,047 | 3/1962 | Johnson | 221/30 |
| 3,129,814 | 4/1964 | Cheh et al. | 206/56 |
| 3,169,895 | 2/1965 | Sohn | 156/361 |
| 3,260,404 | 7/1966 | Critchell | 221/13 |
| 3,340,789 | 9/1967 | Simjian | 99/352 |
| 3,340,790 | 9/1967 | Simjian | 99/352 |
| 3,428,733 | 12/1969 | Groves | 221/25 |
| 3,853,235 | 12/1974 | Lambert et al. | 414/412 |
| 4,843,801 | 7/1989 | Roncero | 414/411 |
| 5,142,335 | 8/1992 | Sakata et al. | 222/DIG. 1 |

FOREIGN PATENT DOCUMENTS

| | | | |
|---|---|---|---|
| WO82/00456 | 2/1982 | PCT Int'l Appl. | B67B 7/00 |
| WO91/07332 | 5/1991 | PCT Int'l Appl. | B65D 75/34 |

*Primary Examiner*—Andres Kashnikow
*Assistant Examiner*—Christopher G. Trainor
*Attorney, Agent, or Firm*—Frank Pincelli

[57] ABSTRACT

Dispensing apparatus are well known for dispensing material from a package. Described herein is apparatus for dispensing predetermined amounts of material (10, 10') stored in vessels (12) carried by a continuous web (14). Each vessel (12) comprises a body portion (15) and a cap portion (16) with one end (22) of a pressure sensitive strip (24) positioned therebetween, the other end (26) of strip (24) being attached to the continuous web (14). The apparatus comprises a roller (28) over which the web (14) moves. Tightening of the strip (24) as the web (14) passes over the roller (28) causes the body portion (15) of the vessel (12) to become detached from the cap portion (16) and the material (10') is released.

6 Claims, 2 Drawing Sheets

DISPENSING APPARATUS

Figure 1:
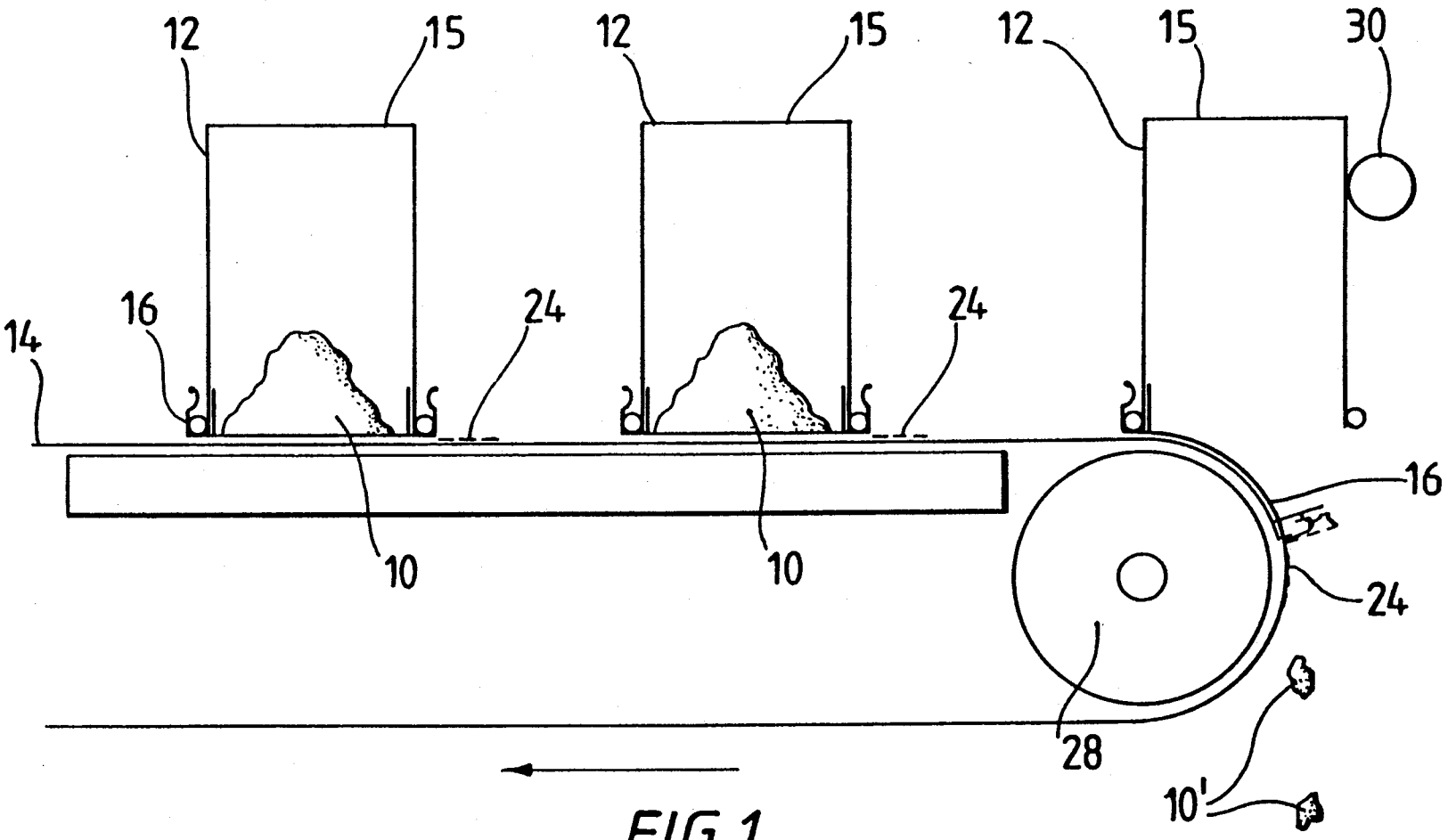

This invention relates to dispensing apparatus and is more particularly, although not exclusively related to dispensing apparatus for use in dispensing replenishment materials for photographic processing equipment.

It is well-known to package material in 'blister' packs which comprise a 'blister' portion attached to a frangible backing portion, the material being retained between the 'blister' portion and the backing portion until pressure is applied to the 'blister' portion to force the material out through the backing portion. One well-known use of such packs is for the storage of medicaments in tablet form.

U.S. Pat. No. 2,889,958 discloses a dispensing device for dispensing articles in unit form. The articles are stored pockets formed in a pliable strip. The pockets are formed by two strip portions which are joined together to form the pliable strip. The strip is folded in accordion fashion and stored in a box arrangement. The articles are dispensed by pulling the strip up through an opening in the box arrangement and under a guide plate which causes the two portions of the strip making up the pocket to open and release the article.

U.S. Pat. No. 3,340,789 discloses dispensing apparatus for dispensing food stored in a package in the form of a long flexible band. In this apparatus, the package containing the food is passed from a refrigerator in a continuous strip, where the food is stored prior to use, to a conditioning station where the food is conditioned before passing on to a dispensing station. At the dispensing station, the food is removed from the packaging using a knife edge which allows the food to fall into a receptacle positioned below the knife edge. The empty packaging, still in strip form, is then passed through a roller arrangement into a collection container.

U.S. Pat. No. 3,340,790 discloses a similar arrangement to that disclosed in U.S. Pat. No. 3,340,789. The packaging in this case is not in strip form but in the form of individual sachets or packets. As in U.S. 3,340,789, each sachet or packet is opened by a knife edge at a food removal station after passing from the refrigerator to a conditioning station.

U.S. Pat. No. 3,260,404 describes a plastic web comprising a plurality of pouches in which articles are stored prior to dispensing. Each pouch has a closed side and a partly open side through which the article can be dispensed. In order to effect dispensing of the articles, the web is directed to an ejecting station where an air jet is applied to the closed side of each pouch to force the article stored therein through the open side.

U.S. Pat. No. 3,482,733 describes a strip package comprising a carrier strip and a plurality of cover strips each containing material to be stored prior to dispensing. Each cover strip is spaced from its adjacent cover strip by an incision through which tear-off blade separates the cover strip from the carrier strip to dispense the material stored therein. The carrier strip further includes feed holes to allow for accurate delivery of the package for dispensing.

However, none of the packaging described above allows for the components making up the packaging to be re-used.

According to one aspect of the present invention, there is provided dispensing apparatus for dispensing material stored in vessels attached to a continuous web, each vessel comprising a body portion and a cap portion, the apparatus comprising:

drive means for driving the web through the apparatus, and removal means for removing the material from the vessels, characterized in that the removal means includes a strip of material, one end of which is positioned between the body portion and its cap portion, and the other end of which is attached to the web, the strip being tightened to cause the vessel to become detached from its cap portion as the web passes through the apparatus to release the material stored therein.

Figure 2:
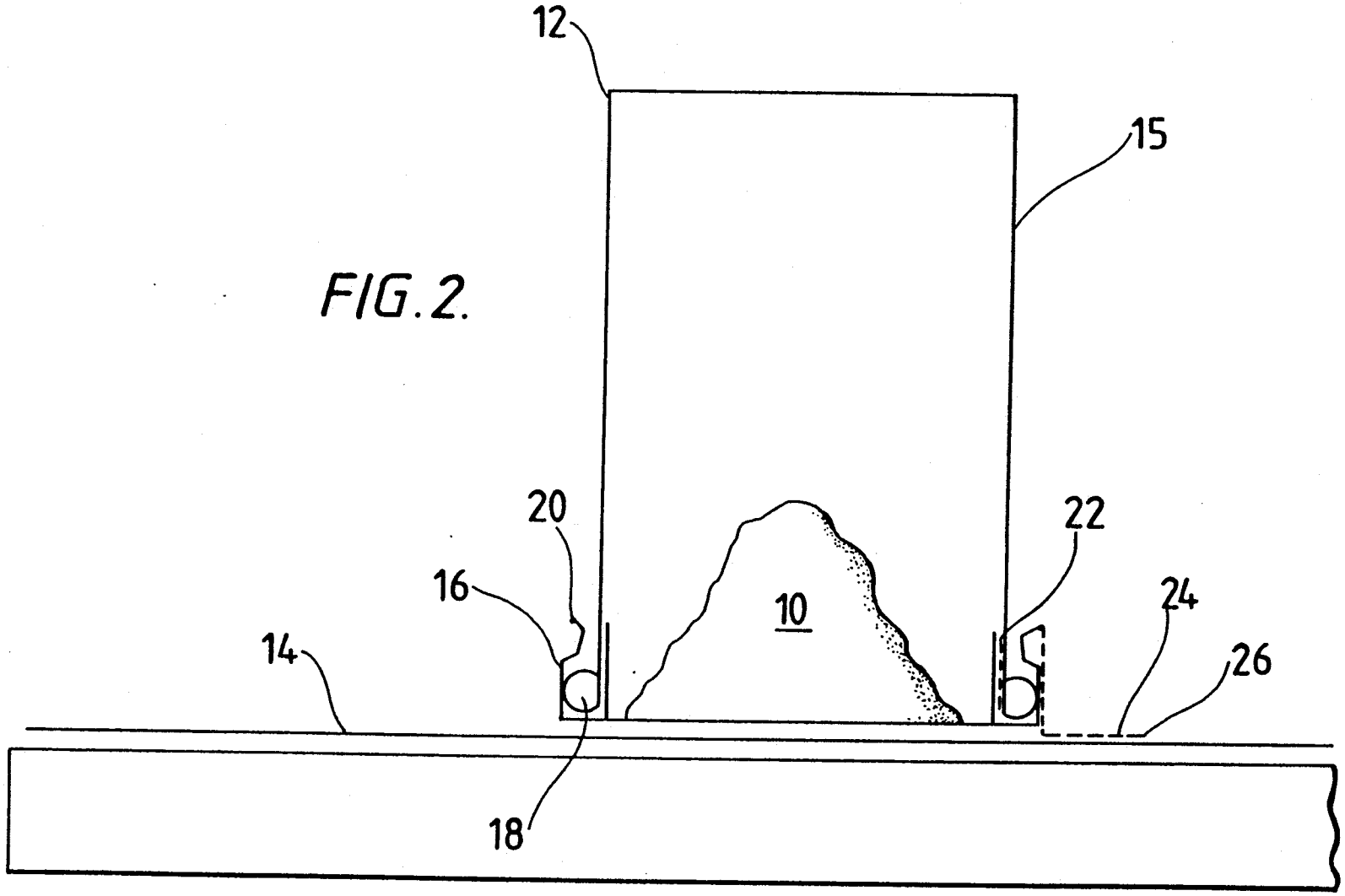

For a better understanding of the present invention, reference will now be made, by way of example only, to the accompanying drawings in which:

FIG. 1 is a schematic side elevation of dispensing apparatus according to the present invention; and FIG. 2 is an enlarged schematic view of a vessel showing its attachment to a continuous web.

In the Figures, material 10 for treating photographic effluent or for replenishing photographic processes is stored in a plurality of rigid storage vessels 12 which are carried on a flexible web 14. Each vessel 12 comprises a body portion 15 and a cap portion 16. This is shown more clearly in FIG. 2. The vessels 12 are attached to the web 14 by way of the cap portions 16. The material 10 is stored in the vessels 12 and attached to the web 14 until it is required for use.

The body portion 15 has a lip portion 18 which is shaped to engage with a moulding 20 formed on the cap portion 16. One end 22 of a strip of material 24 is threaded between the cap portion 16 and the body portion 15 prior to the cap portion 16 being attached. The other end 26 of the strip 24 is attached to the web 14.

The material 10 required for a process is weighed into suitably shaped and sized body portions 15. The cap portions 16 fit tightly on to the filled body portions 15 so that the material 10 retained therein is not spilled during storage and transportation by the web 14. The moulding 20 formed in each cap portion 16 provides a tight fit with the lip portion 18 of the body portion 15, trapping end 22 of strip 24, so that it is less likely that the body portion 15 will be detached from the cap portion 16 during handling. The cap portions 16 are attached to the web 14 using a suitable glue, or other fixing. The cap portions 16 may be attached to the web 14 using automated machinery if suitable.

Vessels 12 (body portions 15 and cap portions 16) and strips 24 are made of suitably inert materials, that is, materials which do not react with the material 10 to be stored within the closed vessels 12.

Each vessel 12 contains a pre-weighed amount of material 10 and which can be added to the process according to requirements. The material 10 may be either in solid or liquid form as desired or even in the form of a mixture or slurry. Furthermore, the material 10 can be put into the vessels 12 at a site remote from the processing apparatus. This means that precision weighing of solids or dispensing of liquids can be carried out away from the processing site in an environment more suitable to that particular function. This also reduces the cost of machinery near the process and removes the possibility of corrosion of the weighing or measuring apparatus.

In FIG. 1, a simple arrangement for dispensing the material 10 is shown. The apparatus comprises a drive mechanism (not shown in detail) for moving the web 14 and the attached vessels 12 through it. As shown, the web 14 is arranged to pass over at roller 28. The roller 28 is driven by conventional means (not shown) and causes the web 14 to pass around it. As strip 24 is attached to web 14 at end 26, it is pulled tight as the web 14 passes over roller 28. This causes the body portion 15 to pop out of its associated cap portion 16 and become detached therefrom. The material 10 originally stored in the rigid vessel 12 is then free to fall away, indicated as 10'. This material 10' can then be used to replenish any photographic process which needs to be replenished.

The web 14 passes under a stop bar 30 which is positioned such that body portion 15 will fall away from the web 14.

Although a stop bar 30 is described as being used to cause the body portions 15 to fall away, any other obstruction which has the same effect can be used instead.

Furthermore, the roller 28 can be replaced by any other means which allows the web 14 to change its direction of movement, for example, a sharp edge. In such a case, the drive for the web 14 is located elsewhere in the apparatus. For example, the drive may be a pair of pinch rollers which pull the web at its edges through the apparatus and then direct the used web to a waste bin or other collection arrangement. Alternatively, one of the pinch rollers may serve as a base on to which the web is re-wound after the material and vessel have been removed.

In a specific example, material was weighed into cylindrical vessels about 50 mm high and having a diameter of about 25 mm. The material was weighed into each vessel using a balance. The vessels were then pushed on to cap portions which were lightly glued on to a web made of ESTAR TM material using glue from a 'hot glue' gun. A pressure sensitive adhesive strip was passed squashed between the lip portion of the vessel and the cap portion as the cap portion was applied to the vessel. The free end of the strip was then stuck on to the web.

When the material stored in the vessels was needed for replenishing a process, the web was loaded on to the arrangement shown in FIG. 1. In this case, the roller was driven by a hand-crank, but naturally other drive means could be used. The vessel was pulled up against the stop bar as the web was pulled around the roller. Collection means were provided to collect the empty vessels after their contents had been added to the process.

The dispensing arrangement was tested with vessels filled separately with calcium hydroxide, activated charcoal and water. In all cases, more that 98% of the material was dispensed into the processing vessel.

It is to be noted that the web 14, body portions 15, cap portions 16 and strips 24 can all be recycled by re-filling the body portions 15 and reattaching them to the cap portions still glued to the web.

We claim:

1. Dispensing apparatus for dispensing material (10) stored in vessels (12, 15, 16) attached to a continuous web (14), of said each vessel (12, 15, 16) comprising a body portion (15) and a cap portion (16), the apparatus comprising:

drive means (28) for driving the web (14) through the apparatus, and removal means (22, 24, 26, 28) for removing the material (10) from the vessels (12, 15, 16), characterized in that the removal means (22, 24, 26) includes a strip of material (24), one end (22) of which is positioned between the body portion (15) and the cap portion (16), and the other end (26) of which is attached to the web (14), the strip (24) being tightened to cause the body portion (15) to become detached from the cap portion (16) as the web (14) passes through the apparatus to release the material (10) stored therein.

2. Apparatus according to claim 1, wherein an obstruction (30) is further provided for engaging the body portion (15) of each of said vessels (12, 15, 16) and causing it to fall away once it has been detached from the cap portion (16).

3. Apparatus according to claim 2, wherein the removal means (22, 24, 26) further includes web direction changing means (28) over which the web (14) passes to cause the strip to be tightened to release the material (10).

4. Apparatus according to claim 3, wherein the obstruction (30) comprises a stop bar positioned above the web direction changing means (28).

5. Apparatus according to any one of claims 1, wherein the drive means (28) comprises at least one roller over which the web (14) moves.

6. Storage means (12, 14, 15, 16) for storing predetermined amounts of material (10) comprising a continuous web (14) and a plurality of vessels (12, 15, 16) attached to the web (14), each of said vessels (12, 15, 16) comprising a body portion (15) and a cap portion (16), said cap portion being secured to said web and receiving said body portion, and means being provided for detaching said body portion from said cap portion.

* * * * *